US006488810B1

(12) United States Patent
Halmschlager

(10) Patent No.: US 6,488,810 B1
(45) Date of Patent: Dec. 3, 2002

(54) PROCESS AND DEVICE FOR PRODUCING A FIBROUS MATERIAL WEB

(75) Inventor: Günter Halmschlager, Krems (AT)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 193 days.

(21) Appl. No.: 09/621,654

(22) Filed: Jul. 21, 2000

(30) Foreign Application Priority Data

Jul. 28, 1999 (DE) ..... 199 35 481

(51) Int. Cl.[7] ..... D21F 3/00

(52) U.S. Cl. ..... 162/109; 162/111; 162/113; 162/197; 162/271; 162/358.1

(58) Field of Search ..... 162/109, 111–113, 162/125, 129, 130, 197, 208, 270, 271, 407, 358.1–358.2

(56) References Cited

U.S. PATENT DOCUMENTS 1,196,888 A * 9/1916 Scherf ..... 162/196
1,582,838 A * 4/1926 Lorenz ..... 162/113
1,582,842 A * 4/1926 Lorenz ..... 162/113
1,676,759 A * 7/1928 Widmer ..... 162/113
2,008,182 A * 7/1935 Kemp ..... 264/283
2,996,425 A * 8/1961 Hamilton ..... 162/113
RE25,335 E * 2/1963 Hamilton ..... 162/113
3,104,197 A * 9/1963 Back et al. ..... 162/113
3,148,108 A * 9/1964 Cluett ..... 162/155
3,161,563 A 12/1964 Walker et al.
3,207,657 A * 9/1965 Wagner et al. ..... 162/208
3,301,173 A 1/1967 Moody
3,523,865 A * 8/1970 Ihrman ..... 162/111
6,146,499 A * 11/2000 Lin et al. ..... 162/197

* cited by examiner

*Primary Examiner*—Jose A. Fortuna
(74) *Attorney, Agent, or Firm*—Greenblum & Bernstein, P.L.C.

(57) ABSTRACT

Process and apparatus for influencing web characteristic in a machine for producing a fibrous web. The process includes guiding the fibrous material web in a still-wet state and stretching the still-wet state fibrous material web in a crosswise direction. The apparatus includes a stretching device arranged to stretch the fibrous material web in a still-wet state in a direction crosswise to a travel direction.

37 Claims, 2 Drawing Sheets

PROCESS AND DEVICE FOR PRODUCING A FIBROUS MATERIAL WEB

CROSS-REFERENCE TO RELATED APPLICATIONS

The present application claims priority under 35 U.S.C. §119 of German Patent Application No. 199 35 481.2, filed on Jul. 28, 1999, the disclosure of which is expressly incorporated by reference herein in its entirety.

BACKGROUND OF THE INVENTION

1. Field of the Invention

The present invention relates to a process and device for producing a fibrous material web, in particular a paper or cardboard web, in which the fibrous material web is appropriately treated for the purpose of influencing certain web characteristics such as, in particular, the web structure and/or the fiber orientation.

2. Discussion of Background Information

It is known that, in the current conventional processes for producing fibrous material webs such as, in particular, paper webs, a more or less clear orientation of the fibers in the machine direction occurs. The average fiber orientation can be varied within certain boundaries dependent upon the operating characteristics of the sheet forming unit, i.e., dependent upon whether an overdamming or an underdamming is present, and upon the forces in the machine, in which situation the average fiber orientation defined by the sheet forming unit can only be changed in the direction of a greater longitudinal orientation, e.g., by means of forces in the press section.

It is further known that the edges of a fibrous material web shrink more than the web center in a conventional drying method. Different sheet characteristics across the web width result from this.

In a process known from U.S. Pat. No. 3,301,173, the elasticity of a belt is used to influence web characteristics in that the relatively dry web is compressed by the belt such that a microcreping of the web occurs with a corresponding change in thickness. In this process, the deformation of the belt thus primarily results in a thickness/length variation. However, besides the desired increase in flexibility and energy absorption, such as compression and/or microcreping of the relatively dry web always causes a significant loss in tensile strength in the lengthwise direction of the fibrous material web because some of the fibers are broken.

SUMMARY OF THE INVENTION

An aspect of the invention is to create a process and a device of the kind mentioned at the outset in which the aforementioned disadvantages are eliminated. This should particularly also create the possibility of, on the one hand, influencing and preferably increasing the degree of orientation of the fibers crosswise to the operating direction of the machine and, on the other hand, deliberately influencing the structure of the fibrous material web, in a simple and reliable manner.

This aspect is attained with regard to the process in that, in order to influence the applicable web characteristics, the fibrous material web is correspondingly stretched in the crosswise direction while still damp.

Because of this construction, it is now possible, on the one hand, to influence and preferably increase the orientation of the fibers crosswise to the operating direction of the machine and, on the other hand, to deliberately influence the structure of the fibrous material web, which also allows a deliberate influence across the width of the web, if necessary. With a deliberate crosswise stretching of the fibrous material web, the breaking length ratio is decreased as well. During tightening, the elastic belt furthermore behaves similarly to a web in a drying section, i.e., the edges behave differently from the middle of the web because of the different edge conditions. As a result, the contraction of the belt is also different across the width, which has the effect that the web edges are stretched more than the middle of the web. This effect works against an increased edge shrinkage of the web in the drying section and compensates partially or completely therefor. With the crosswise stretching of the fibrous material web, different characteristics of the web, e.g., a paper web, can be influenced, if necessary, also deliberately across the web width.

Among the characteristics of the fibrous material web that can be correspondingly influenced are, e.g., the porosity that can be increased as a result of a loosening of the structure, the smoothness or the smoothness profile, the strengths in the crosswise direction, and the stretching characteristics in the lengthwise direction. The open porosity achieved can, for example, improve the press performance and/or the drying performance. Furthermore, a better or more even acceptance of glue can also be achieved, for example.

The still-wet fibrous material web is suitably stretched in the crosswise direction with a solids content of around 5% to around 65%, in particular of around 5% to around 55%, and preferably of around 15% to around 25%.

In a preferred practical embodiment of the process according to the invention, the fibrous material web is transferred in its still-wet state onto an endless elastic belt which was stretched in the lengthwise direction before the transfer point and whose stretching behavior is adjusted in various directions such that, with the preceding lengthwise stretching of the belt, a crosswise contraction of the belt corresponding to the lengthwise contraction of the belt occurring after the transfer point primarily causes a crosswise stretching of the belt and the fibrous material web is stretched in the crosswise direction thereby.

It is advantageous in this situation for the stretching behavior of the elastic belt to be adjusted separately in the thickness and width direction in such a way that, with a lengthwise stretching or lengthwise contraction of the belt, at least essentially only a crosswise contraction of the belt and/or crosswise stretching of the belt occurs without significant changes in thickness. In comparison to the variation in thickness that has been common up to now, the fibers in the fibrous material web are thus no longer contracted, but rather reoriented. The preceding stretching of the elastic belt in the lengthwise direction suitably follows immediately before the transfer point.

The lengthwise stretching of the belt before receiving the fibrous material web can occur in different ways. In a suitable practical embodiment, the elastic belt is tensed by at least one driven rotating roll, and especially at least two rotating rolls driven in opposite directions and thus stretched in the lengthwise direction. The fibrous material web is preferably transferred to the elastic belt in the region of this one roll and/or the last of these rolls.

The transfer of the still-wet fibrous material web to the elastic belt suitably occurs at a solids content of the web of around 5% to around 65% weight, in particular of around 5% to around 55% weight, and preferably of around 15% to around 25% weight.

Additionally, besides the function of a crosswise stretching of the fibrous material web, the elastic belt can also fulfill one or more further functions. Thus, a belt serving at the same time as a pressing felt can be used as an elastic belt. It is fundamentally also possible to use a belt that is simultaneously serving as a transfer belt as an elastic belt. Such combinations have the advantage that only a few new machine components are necessary.

In a suitable embodiment, an elastic belt with a stretching behavior that varies across the web width is used, by which means different effects can be achieved, such as, e.g., the previously mentioned effect of a decreased edge shrinkage behavior of the web. As needed, an elastic belt with a closed surface or a porous elastic belt can be used.

In a suitable practical embodiment, the fibrous material web is transferred to the elastic belt by a transport belt such as, in particular, a wet wire, a transfer belt, or the like.

The device according to the invention is correspondingly characterized in that it includes a device for stretching the fibrous material web for the purpose of influencing certain web characteristics such as, in particular, the web structure and/or the fiber orientation in the crosswise direction in the still-wet state.

According to an aspect of the present invention a process is provided for influencing web characteristic in a machine for producing a fibrous web, the process including guiding the fibrous material web in a still-wet state; stretching the still-wet state fibrous material web in a crosswise direction.

According to another aspect of the present invention, the web characteristic includes at least one web structure and fiber orientation. In another aspect of the present invention the fibrous material web includes one of paper and cardboard.

According to a further aspect of the present invention, when stretched, the still-wet fibrous material has a solids content of about 5% to about 65%. Moreover, when stretched, the still-wet fibrous material web has a solids content of about 5% to about 55%; in particular about 5% to about 55%, and preferably around 15% to 25%.

In another aspect of the present invention, the process includes stretching a continuous elastic belt in a lengthwise direction before a transfer point, in which a cross-wise direction contraction results, transferring the fibrous material web onto the lengthwise stretched continuous elastic belt at the transfer point, and lengthwise contracting the continuous elastic belt after the transfer point, in which a cross-wise direction expansion results. In this manner, the fibrous material web is stretched in the crosswise direction.

According to a still further aspect of the present invention a process is provided wherein a stretching behavior of the elastic belt is such that the stretching and contracting in the lengthwise direction substantially effects the cross-wise direction contracting and expansion without significantly changing a thickness of the elastic belt.

Further aspects of the invention provide a process wherein the elastic belt is stretched in a longitudinal direction immediately before the transfer point. According to other aspects of the present invention the stretching of the continuous elastic belt is effected by at least one driven rotating roll.

According to another aspect of the present invention the stretching of the continuous elastic belt is effected by at least two driven rolls rotating in opposite directions. According to an aspect of the invention the fibrous material web is transferred to the elastic belt in a region of a last roll used for stretching.

In another aspect of the present invention, the still-wet state fibrous material web is transferred to the elastic belt with a solids content of about 5% to about 65%; in particular about 5% to about 55%; and preferably about 15% to about 25%.

According to a further aspect of the present invention the continuous elastic belt includes a pressing felt. In another aspect of the present invention the continuous elastic belt includes a transfer belt. According to a further aspect of the present invention the continuous elastic belt has a stretching behavior that varies across the web width.

In another aspect of the present invention the elastic belt has a closed surface. According to still a further aspect of the present invention the elastic belt is porous. According to still a further aspect of the present invention the fibrous material web is transferred to the elastic belt from a transport belt comprising one of a wet wire and a transfer belt.

Further aspects of the invention include stretching the fibrous material web in the crosswise direction increases the degree of orientation of the fibers in the crosswise direction. According to other aspects of the present invention the stretching of the fibrous material web in the crosswise direction influences the structure of the fibrous material web is provided.

According to another aspect of the present invention an apparatus is provided for producing a fibrous material web. The apparatus includes a stretching device arranged to stretch the fibrous material web in a still wet state in a direction crosswise to a travel direction.

According to a further aspect of the present invention an apparatus is provided including wherein the stretching device is adapted to influence at least one of web structure and fiber orientation in the fibrous material web. According to a still further aspect of the invention the fibrous material web includes one of a paper and cardboard.

According to an aspect of the present invention, the apparatus includes an elastic belt positioned to receive the still-wet state fibrous material web at a transfer point. The elastic belt is stretched in a lengthwise direction before the transfer point, in which a crosswise contraction of the elastic belt can result, and the elastic belt is contractible after the transfer point, in which the crosswise stretching of the elastic belt can result. In this manner, the fibrous material web is stretched in the crosswise direction.

According to another aspect of the invention a stretching behavior of the elastic belt is such that the stretching and contracting in the lengthwise direction substantially effects the cross-wise direction contracting and expansion without significantly changing the thickness.

In another aspect of the present invention, an apparatus is provided including a driven rotating roll arranged to stretch the elastic belt in the lengthwise direction, wherein the elastic belt is tensed around said driven rotating roll.

According to a further aspect of the present invention the transfer point is located in a region of the driven roll. According to a still further aspect of the present invention, the elastic belt comprises a pressing felt. Further aspects of the invention include an elastic belt that includes a transfer belt.

According to other aspects of the invention, the apparatus has an elastic belt having a stretching behavior that varies across a width of the web. According to another aspect of the present invention the elastic belt has a closed surface. According to a further aspect of the present invention the elastic belt is porous.

According to another aspect of the present invention an apparatus is provided having a transport belt arranged to guide the fibrous web before the transfer point, wherein the fibrous material web is transferred to the elastic belt from a transport belt. In another aspect of the present invention the transfer belt comprises a wet wire.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
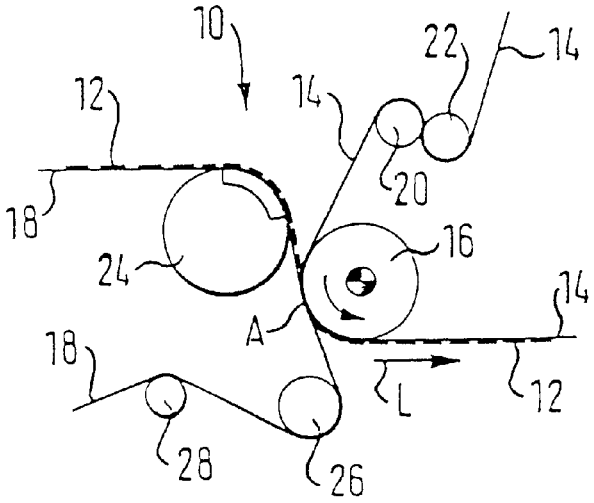
FIG. 1 is a schematic partial depiction of a device serving to produce a fibrous material web.
Figure 2:
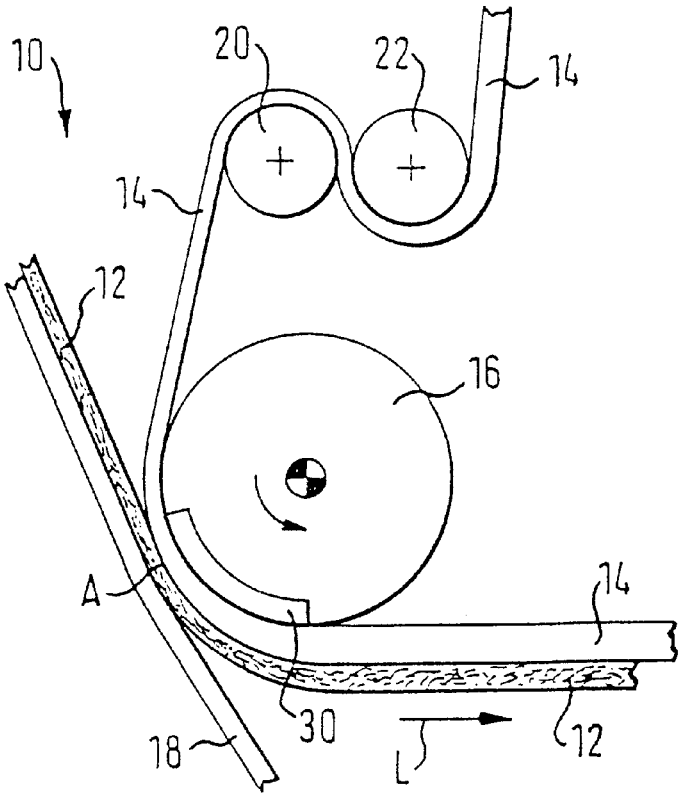
FIG. 2 is an enlarged schematic depiction of the region of the device shown in FIG. 1 serving to stretch the web with an elastic belt stretched by means of at least one driven roll.
Figure 3:
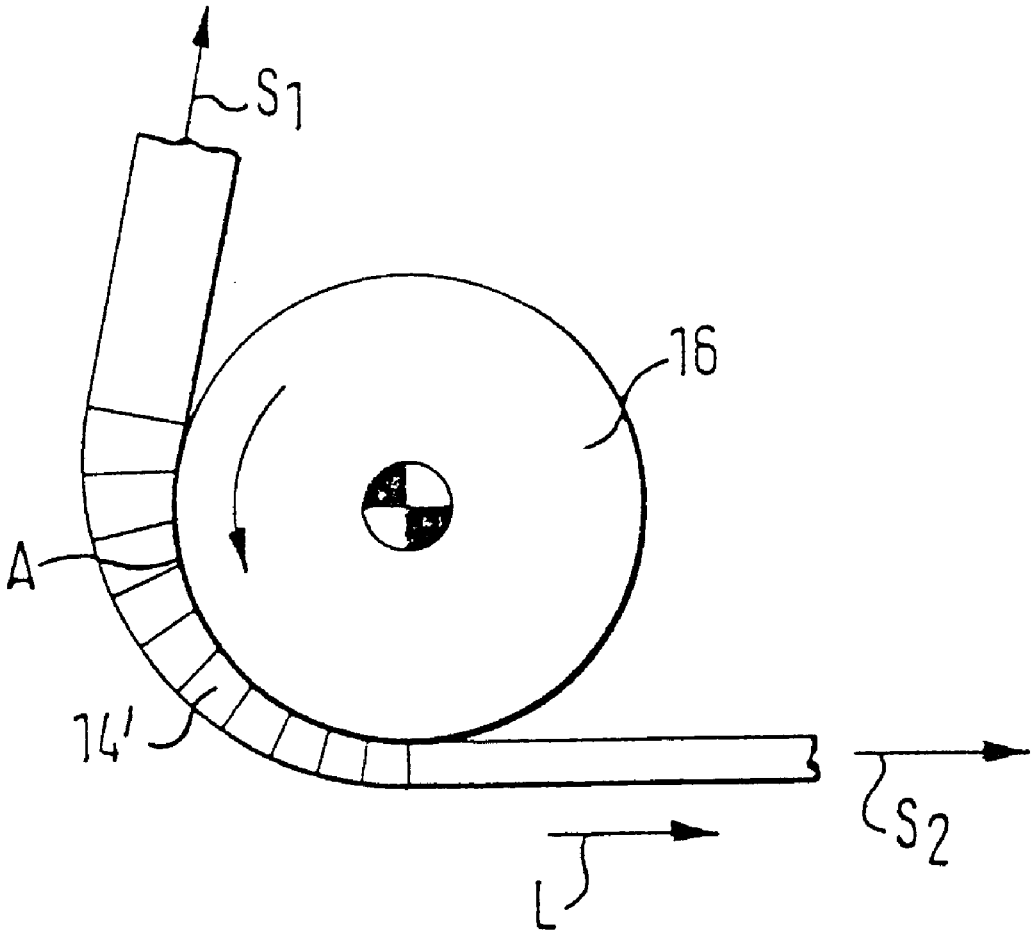
FIG. 3 is a schematic depiction of the stretching process of the belt section stretched around a driven roll.

FIGS. 1–3 show a section of a device 10 for producing a fibrous material web 12 which can, in particular, be a paper or cardboard web.

The device 10 includes stretching components 14, 16 for correspondingly stretching the fibrous material web 12 for the purpose of influencing certain web characteristics such as, in particular, the web structure and/or the fiber orientation in the crosswise direction in the still-wet state. In the present exemplary embodiment, an elastic belt 14 is provided for such a crosswise stretching of the web, which belt has taken over the still-wet fibrous material web 12, has been stretched in the lengthwise direction before the transfer point A, and has been tensed by at least one driven rotating roll 16 and stretched in the lengthwise direction thereby. The fibrous material web 12 is transferred onto the elastic belt 14 by a transport belt 18 such as, in particular, a wet wire, a transfer belt, or the like.

Before the driven roll 16 in the web travel direction L, the elastic belt 14 is guided over a deflection roll 20. If desired, a tensing roll 22 can also be provided, by which the web tension can be correspondingly adjusted. In the present exemplary embodiment, such a tensing roll 22 is provided immediately before the deflection roll 20. In particular, it is also possible for the roll 20 and/or the roll 22 to be driven in the opposite direction of the roll 16 in order to tense the elastic belt 14.

Before the transfer or take-over point, the transport belt 18 is guided, e.g., over a suction roll 24. In FIG. 1, deflection rolls 26, 28 can also be seen, over which the transport belt 18 is guided behind the transfer point A. The transfer point A, on which the elastic belt 14 tensed over the driven roll 16 takes the fibrous material web 12 from the transport belt 18, lies between the suction roll 24 and the deflection roll 26.

Insofar as a porous belt 14 is used, the driven roll 16 can also be supplied with suction. In FIG. 2, the driven roll 16 is provided with a corresponding suction zone 30.

As can be seen from FIG. 3, the transport belt 18 is separated from the fibrous material web 12 after the fibrous material web has been successfully taken over by the elastic belt 14 in the region of the driven roll 16 and the fibrous material web 12 is subsequently carried along by the elastic belt 14 that is tensed around the driven roll 16.

The stretching behavior of the elastic belt 14 in the various directions is adjusted such that, with the preceding lengthwise stretching of the belt 14, a primarily crosswise contraction of the belt occurs and, corresponding to the lengthwise contraction of the belt 14 after the transfer point A, a primarily crosswise stretching of the belt 14 occurs and the fibrous material web 12 is thereby stretched in the crosswise direction. Here, the stretching behavior of the elastic belt 14 is adjusted differently in the thickness and width directions in such a way that, with a lengthwise stretching or lengthwise contraction of the belt 14, essentially only a crosswise contraction or crosswise stretching of the belt occurs without substantial changes in thickness.

FIG. 3 shows the tension progression of the belt section 14' that is tensed around the driven roll 16. According to this, the belt tension $S_1$ before the transfer point A in the web travel direction L is greater than the web tension $S_2$ behind this transfer point, with this value decreasing along the roll circumference. After the fibrous material web 12 has been taken over, the elastic belt 14 thus essentially reassumes its original form, whereby the fibrous material web 12 is stretched crosswise to the web travel direction L.

The elastic belt 14 can simultaneously serve as a pressing felt. Fundamentally the use of an elastic belt 14 that simultaneously serves as a transfer belt is also possible, for example. Moreover, the elastic belt 14 can have different stretching behavior across the web width.

While a porous elastic belt 14 that is tensed around a suctioned driven roll 16 is provided in the exemplary embodiment shown in FIG. 2, the use of an elastic belt 14 with a closed surface is also possible, of course. In this case, the driven roll 16 would not be suctioned.

With the crosswise stretching of the still-wet fibrous material web, various web characteristics, including, e.g., the web structure and the fiber orientation, can be correspondingly influenced.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for influencing web characteristic in a machine for producing a fibrous material web, the process comprising:

stretching a continuous elastic belt in a lengthwise direction;

transferring the fibrous material web in a still-wet state onto the stretched continuous elastic belt;

releasing the lengthwise stretching of the continuous elastic belt, whereby lengthwise contraction of the continuous elastic belt stretches the still-wet state fibrous material web on the lengthwise contracting continuous elastic belt in a crosswise direction.

2. The process according to claim 1, wherein said web characteristic comprises at least one of web structure and fiber orientation.

3. The process according to claim 1, wherein said fibrous material web includes one of paper and cardboard.

4. The process according to claim 1, wherein when stretched, the still-wet fibrous material has a solids content of about 5% to about 65%.

5. The process according to claim 4, wherein, when stretched, the still-wet fibrous material web has a solids content of about 5% to about 55%.

6. The process according to claim 5, wherein when stretched, the still-wet state fibrous material web has a solids content of about 15% to about 25%.

7. The process according to claim 1, wherein the stretching of the continuous elastic belt in the lengthwise direction occurs before a transfer point creates a crosswise direction contraction of the continuous elastic belt, the fibrous material web is transferred onto the lengthwise stretched continuous elastic belt at the transfer point, and the continuous elastic belt is contracted in the lengthwise direction after the transfer point, whereby a cross-wise direction expansion of the elastic belt results while supporting the fibrous material web and stretching the fibrous material web in the crosswise direction.

8. The process according to claim 7, wherein a stretching behavior of the elastic belt is such that the stretching and contracting in the lengthwise direction substantially effects the cross-wise direction contracting and expansion without significantly changing the thickness.

9. The process according to claim 8, wherein the stretching of the continuous elastic belt is effected by at least two driven rolls rotating in opposite directions.

10. The process according to claim 7, wherein the elastic belt is stretched in a longitudinal direction immediately before the transfer point.

11. The process according to claim 7, wherein the stretching of the continuous elastic belt is effected by at least one driven rotating roll.

12. The process according to claim 11, wherein the fibrous material web is transferred to the elastic belt in a region of a last roll used for stretching.

13. The process according to claim 7, wherein the still-wet state fibrous material web is transferred to the elastic belt with a solids content of about 5% to about 65%.

14. The process according to claim 13, wherein the still-wet state fibrous material web is transferred to the elastic belt with a solids content of about 5% to about 55%.

15. The process according to claim 14, wherein the still-wet state fibrous material web is transferred to the elastic belt with a solids content of about 15% to about 25%.

16. The process according to claim 7, wherein the continuous elastic belt comprises a pressing felt.

17. The process according to claim 7, wherein the continuous elastic belt comprises a transfer belt.

18. The process according to claim 7, wherein the continuous elastic belt has a stretching behavior that varies across the web width.

19. The process according to claim 7, wherein the elastic belt has a closed surface.

20. The process according to claim 7, wherein the elastic belt is porous.

21. The process according to claim 7, wherein the fibrous material web is transferred to the elastic belt from a transport belt comprising one of a wet wire and a transfer belt.

22. The process according to claim 1, wherein the stretching of the fibrous material web in the crosswise direction increases the degree of orientation of the fibers in the crosswise direction.

23. The process according to claim 1, wherein the stretching of the fibrous material web in the crosswise direction influences the structure of the fibrous material web.

24. An apparatus for influencing web characteristics during production of a fibrous material web, comprising:

a belt structured for carrying a still wet web to a transfer point;

a continuous elastic belt structured and arranged to receive a still wet web at the transfer point, wherein said continuous elastic belt is structured and arranged to contract crosswise to the belt travel direction when stretched lengthwise and to expand in the crosswise direction when stretching of the continuous elastic belt is released; and a device for stretching said continuous elastic belt in a lengthwise direction before, relative to a belt travel direction, said transfer point and for releasing the stretching of said continuous elastic belt in the lengthwise direction after said transfer point, whereby the still wet web supported on said continuous elastic belt when the stretching of the continuous elastic belt is released is stretched in the crosswise direction.

25. The apparatus according to claim 24, wherein said stretching device is adapted to influence at least one of web structure and fiber orientation in the fibrous material web.

26. The apparatus according to claim 24, wherein said fibrous material web includes one of paper and cardboard.

27. The apparatus according to claim 24, wherein said stretching device includes an elastic belt positioned to receive the still-wet state fibrous material web at a transfer point, wherein said elastic belt is stretched in a lengthwise direction before the transfer point, whereby a crosswise contraction of the elastic belt results, and wherein said elastic belt is contractible after the transfer point, whereby the crosswise stretching of the elastic belt results, and whereby the fibrous material web is stretched in the crosswise direction.

28. The apparatus according to claim 27, wherein a stretching behavior of the elastic belt is such that the stretching and contracting in the lengthwise direction substantially effects the cross-wise direction contracting and expansion without significantly changing the thickness.

29. The apparatus according to claim 27, further comprising a driven rotating roll arranged to stretch the elastic belt in the lengthwise direction, wherein the elastic belt is tensed around said driven rotating roll.

30. The apparatus according to claim 27, wherein said transfer point is located in a region of the driven roll.

31. The apparatus according to claim 27, wherein the elastic belt comprises a pressing felt.

32. The apparatus according to claim 27, wherein the elastic belt comprises a transfer belt.

33. The apparatus according to claim 27, wherein the elastic belt has a stretching behavior that varies across a width of the web.

34. The apparatus according to claim 27, wherein the elastic belt has a closed surface.

35. The apparatus according to claim 27, wherein the elastic belt is porous.

36. The apparatus according to claim 27, further comprising said transport belt arranged to guide the fibrous web before the transfer point, wherein the fibrous material web is transferred to the elastic belt from a transport belt.

37. An apparatus according to claim 27, wherein said transfer belt comprises a wet wire.

* * * * *